US009603778B2

(12) United States Patent
Ajmera

(10) Patent No.: US 9,603,778 B2
(45) Date of Patent: Mar. 28, 2017

(54) INFANT FEEDING SYSTEM

(76) Inventor: Bijal Ajmera, Tulsa, OK (US)

( * ) Notice: Subject to any disclaimer, the term of this patent is extended or adjusted under 35 U.S.C. 154(b) by 0 days.

(21) Appl. No.: 12/947,804

(22) Filed: Nov. 16, 2010

(65) Prior Publication Data

US 2011/0114590 A1 May 19, 2011

Related U.S. Application Data

(60) Provisional application No. 61/261,374, filed on Nov. 16, 2009.

(51) Int. Cl.

| | |
|---|---|
| ***A61J 9/04*** | (2006.01) |
| ***A61J 9/00*** | (2006.01) |
| ***A61J 11/02*** | (2006.01) |
| ***A61J 11/04*** | (2006.01) |

(52) U.S. Cl.

CPC ..... *A61J 9/00* (2013.01); *A61J 11/02* (2013.01); *A61J 11/045* (2013.01)

(58) Field of Classification Search

CPC ..... A61J 11/02; A61J 2009/0623
USPC ..... 215/11.4, 11.5, 11.6, 11.1; 220/366.1, 220/212

See application file for complete search history.

(56) References Cited

U.S. PATENT DOCUMENTS

| | | | | | |
|---|---|---|---|---|---|
| 3,481,500 | A | * | 12/1969 | Palma | 215/11.5 |
| 3,627,161 | A | * | 12/1971 | Wergeland | 215/11.6 |
| 3,747,791 | A | * | 7/1973 | Fouser | 215/11.1 |
| 4,676,386 | A | * | 6/1987 | Phlaphongphanich | 215/11.1 |
| 4,796,770 | A | * | 1/1989 | Begley | 215/252 |
| 5,101,992 | A | * | 4/1992 | Serre | 215/11.5 |
| 5,284,261 | A | * | 2/1994 | Zambuto | 215/11.5 |
| RE34,725 | E | * | 9/1994 | Braden | 119/515 |
| 5,431,290 | A | * | 7/1995 | Vinciguerra | 215/11.5 |
| 5,553,726 | A | * | 9/1996 | Park | 215/11.4 |
| 6,161,710 | A | * | 12/2000 | Dieringer et al. | 215/11.4 |
| 6,968,964 | B2 | * | 11/2005 | Gilmore | 215/11.1 |
| 7,326,234 | B2 | * | 2/2008 | Lieberman et al. | 606/236 |
| 2010/0025352 | A1 | * | 2/2010 | Rieppel | 215/11.4 |
| 2010/0314347 | A1 | * | 12/2010 | Haberman et al. | 215/6 |

* cited by examiner

*Primary Examiner* — Anthony Stashick
*Assistant Examiner* — James M Van Buskirk

(57) ABSTRACT

An infant feeding system. An infant feeding system comprising a bottle with a closed first end and an second end comprising an aperture that is configured to receive a liquid or semi-liquid substance into the bottle, a nipple comprising a vent system, a ring configured to enable the nipple to couple to the second end of the bottle, and a cap configured to couple to the second end of the ring and configured to couple to the first end of the bottle.

20 Claims, 8 Drawing Sheets

INFANT FEEDING SYSTEM

CROSS REFERENCE TO RELATED APPLICATIONS

This is a Continuation of U.S. Patent Application Ser. No. 61/261,374 entitled "Infant Feeding Container," filed on Nov. 16, 2009, which is incorporated by reference.

BACKGROUND OF THE INVENTION

Feeding containers such as a baby bottle having a flexible nipple are used to feed infants, children, or adults with milk, formula, juice, semi-fluids and other fluids. A typical bottle has an open upper end that is threaded for engagement of a ring, which attaches the nipple to the open end. The nipple is coupled to the open end of the bottle by way of the ring. A cap is coupled to the top of the ring. Further, in some cases feeding containers comprise vent systems to enable air flow into the feeding container.

DETAILED DESCRIPTION OF THE INVENTION

While the foregoing written description of the embodiment enables one of ordinary skill to make and use what is considered presently to be the best mode thereof, those of ordinary skill will understand and appreciate the existence of variations, combinations, and equivalents of the specific embodiment, method, and examples herein. The present embodiment should therefore not be limited by the below described embodiment, method, and examples, but by all embodiments and methods within the scope and spirit as claimed.

Figure 1:
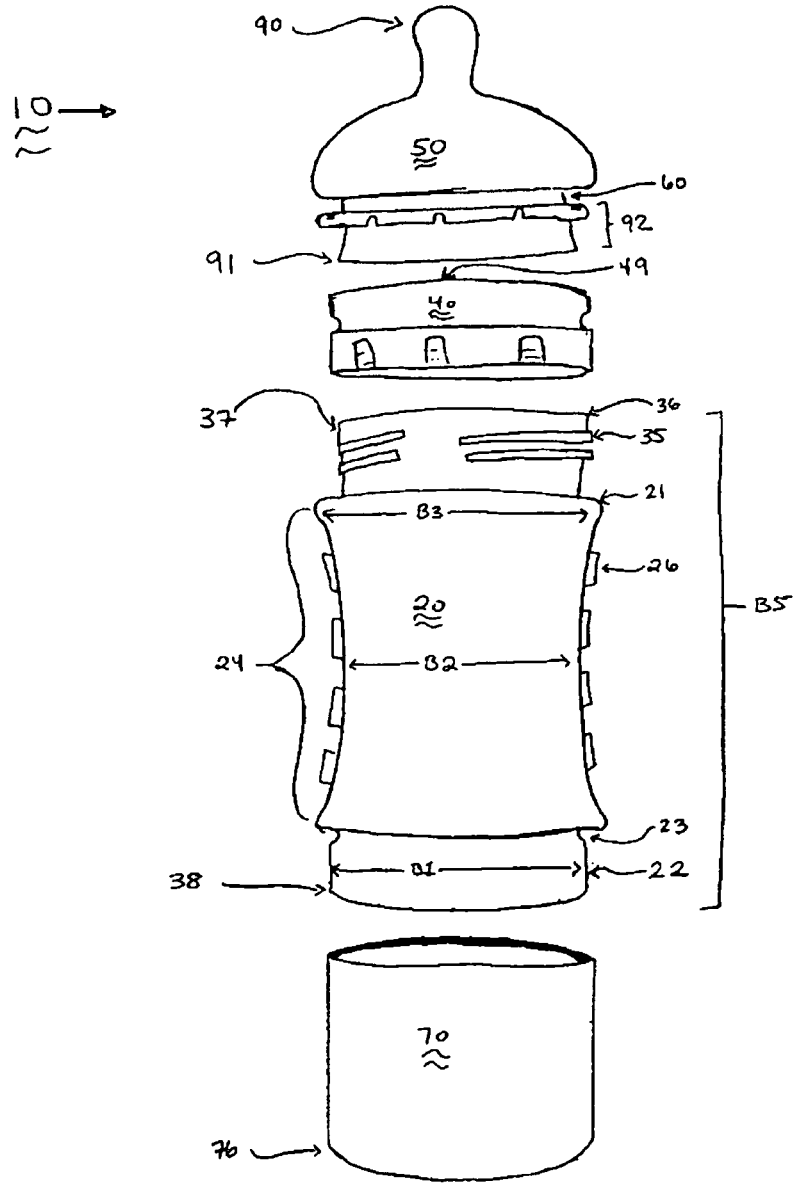
FIG. 1 shows an exploded view of an infant feeding system in accordance with at least some of the embodiments.

FIG. 1 illustrates the exploded view of the infant feeding system 10 with a bottle 20, a ring 40, a nipple 50, and a cap 70. The bottle 20 contains a first end 38 and a second end 37 comprising an aperture that is configured to receive a liquid or semi-liquid substance. In the particular embodiment, the nipple 50 comprises a vent system 92. The nipple 50 couples to the ring 40 and then to the bottle 20. In the particular embodiment, the ring 40 enables the nipple 50 to couple to the second end 37 of the bottle 20. In the particular embodiment, the cap 70 is coupled to the first end 38 of the bottle 20 at the bottle slide-on portion 22 as shown in FIG. 1 and also couples to the second end 44 of the ring 40. In particular, the bottle 20 contains an indentation 23 on proximate to the first end 38 of the bottle 20 to allow the cap 70 to snap fit with the bottle. When the cap 70 is coupled to the first end 38 of the bottle 20, the bottle 20 can rest vertically on the closed second end 76 of the cap 70. By coupling the cap 70 to first end 38 of the bottle 20, the cap 70 is kept from being misplaced or lost. Further, the coupling protects the inside of the cap 70 from contamination when the infant feeding system 10 is in use.

The bottle 20 contains concave indentations 24 with raised grips 26 on two sides of the bottle 20. The concave indentations 24 allow both the feeder and infant to grasp the infant feeding system 10 regardless of their hand size. Further, the raised grips 26 provide the feeder or infant with traction so that the infant feeding system 10 can be securely held without slippage. In one some of the embodiments, the raised grips 26 are comprised of raised alphanumeric characters. In one embodiment, the bottle 20 contains volumetric markings on one side to show the amount of liquid in the infant feeding system 10. The bottle contains a shoulder 21 between the concave indentations 24 and the threads 35. Additionally, the outside surface of the second end 37 of the bottle 20 and the inside surface of the ring 40 are threaded to allow the ring 40 to threadingly couple to the bottle 20.

In the particular embodiment, the nipple 50 comprises a constricted section 60 that is proximate to a circular second end 91 of the nipple 50 to couple to the ring 40. In some embodiments, the nipple 50 is coupled to the ring 40 by inserting the circular second end 91 of the nipple 50 into the aperture 49 of the ring 40 and then the ring 40 is threadingly coupled to the bottle 20. When the nipple 50 is coupled to the ring 40, the coupling of the ring 40 to the bottle 20 presses the nipple 50 against the rim 36 of the second end 37 of the bottle 20 thus creating a secure seal between the nipple 50 and the bottle 20 which reduces the risk of fluid leaking out of the bottle 20 when the infant uses the infant feeding system 10.

In the particular embodiments, the diameter B1 is equal to the diameter B3 and the diameter B2 is less than the diameter B3 and diameter B1. The height of the bottle B5 is larger than the diameters B1, B2, or B3. In the particular embodiment, the bottle 20 is constructed from polypropylene material; however, in other embodiments the bottle 20 may also be constructed from any rigid or semi-rigid materials such as steel, aluminum, wood, plastic, carbon fiber, or glass. Regardless of the material used for construction, the bottle 20 and the other components of the infant feeding system 10 should be able to withstand repeated washing and handling as well as the high temperatures associated with dishwashing, microwaving, baby bottle sterilization, or the handling of liquids, solids, and semi-solids.

Figure 2:
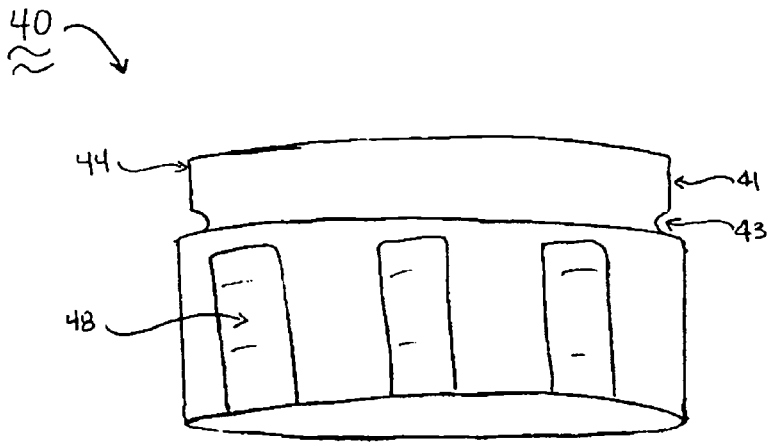
FIG. 2 shows the front view of the ring in accordance with at least some of the embodiments.

FIG. 2 is an illustration of the ring 40. In particular, the second end 44 of the ring 40 contains a slide-on portion 41 with a concave indentation 43. The slide-on portion 41 and concave indentation 43 allows the cap 70 to couple to the ring 40. In one embodiment, the ring 40 has raised bumps 48 on the outer circumference to provide traction when uncoupling the ring 40 from the bottle 20.

Figure 3:
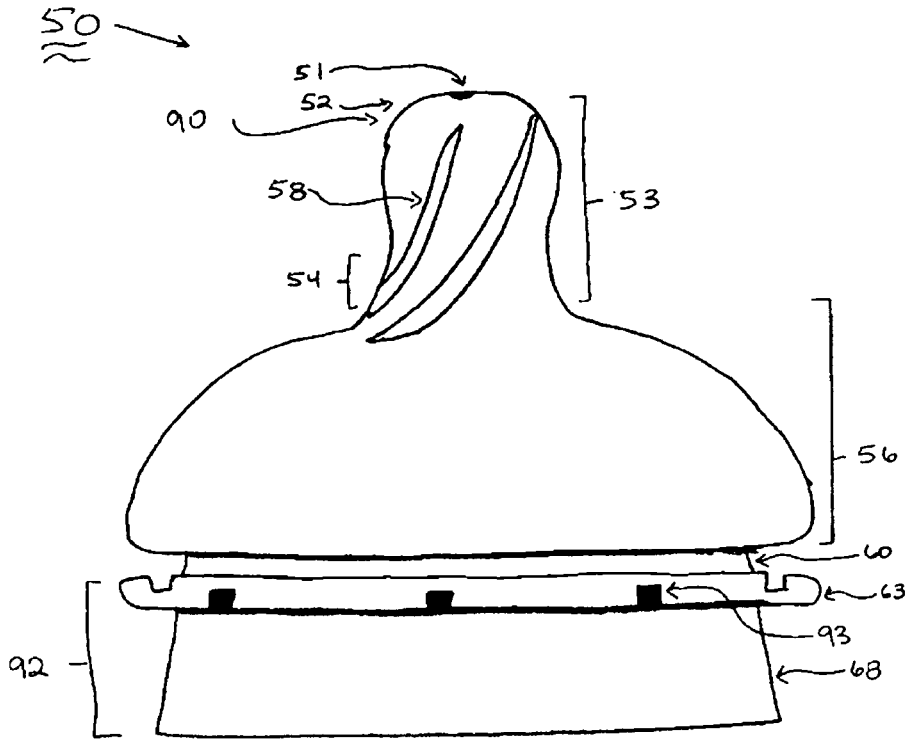
FIG. 3 shows the front view of the nipple in accordance with at least some of the embodiments.

FIG. 3 illustrates the front view of the nipple 50 in accordance with at least one of the embodiments. In particular, the nipple 50 contains a bulbous nipple top 53, a muffin top 56, flow rigidity lines 58, a constricted section 60, a ledge 63, and a vent system 92. The first end of the nipple 50 contains a bulbous nipple top 53 comprising flow rigidity lines 58, upper nipple tip 52, aperture 51, and lower nipple tip 54. The first end 90 of the nipple 50 forms an bulbous nipple top 53 to be placed into the infant's mouth and contains at least one aperture 51 to allow liquid or semi-liquid to come out of the infant feeding system 10. The constricted section 60 is between the muffin top 56 and the vent system 92. The vent system 92 comprises a flap 68, a ledge 63, and concave channels 93. The shape and texture of the nipple 50 prevents nipple confusion by resembling a nipple on a breast as the infant goes between the mother's breast and the nipple 50. In one embodiment, the upper nipple tip 52 has the same diameter as the lower nipple tip 54 and the middle of the nipple top 53 is smaller in diameter than the nipple tip 52. The muffin top 56 has a height that is larger than the height of the nipple top 53.

In the particular embodiment, the nipple 50 is constructed of silicone material; however, in other embodiments the nipple 50 may also be constructed from any rigid, semi-rigid, or flexible materials such as plastic, steel, rubber, wood, latex, or glass. In the particular embodiment, the nipple 50 is semi-transparent; however, in other embodiments, the nipple 50 may also transparent or non-transparent. The elasticity of the nipple 50 along with its texture, size, and shape provides an infant with the tactile feel of a mother's natural breast, thereby reducing the risk of an infant solely preferring the infant feeding system 10 to the mother's breast. In one embodiment, the muffin top 56 has a rough texture. In one embodiment, the nipple top 53 has a rough texture. The nipple 50 contains flow rigidity lines 58 inside of the nipple top 53 to allow the fluid to exit the nipple aperture 51 at the correct velocity and add rigidity to the nipple top 53. In one embodiment, the flow rigidity lines 58 are diagonally positioned within the nipple top 53. In one embodiment, there are a plurality of rigidity lines 58. The length of the nipple top 53 positions the tip in the back of the baby's mouth. The texture, rigidity, shape, and size of the nipple top 53 mimics the mother's breast requiring the baby to coordinate its tongue and jaw movements in a sucking motion similar to breastfeeding to release liquid instead of easily biting on the nipple top 53 to release the liquid. Since the nipple top 53 is far back in the baby's mouth there is less compression of the nipple top 53 by the baby's gums or teeth reducing soreness of the baby's gums.

Figure 4:
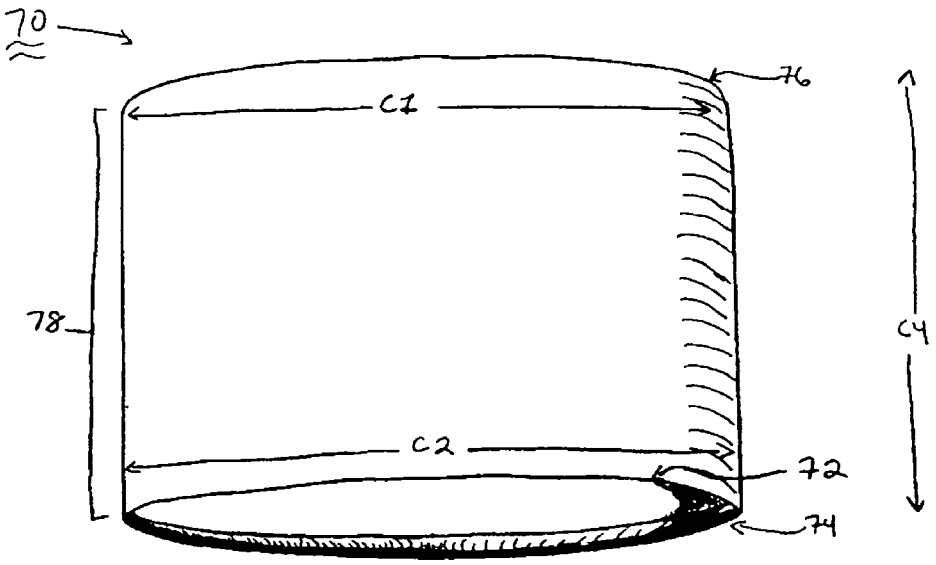
FIG. 4 shows the cap in accordance with at least some of the embodiments.

FIG. 4 is an illustration of the cap 70. In particular, the cap 70 contains a closed second end 76 and first open end 72 of the cap 70 containing a snap-on protrusion 74 on the inner circumference. The first open end 72 of the cap 70 slides onto the the slide-on portion 41 of the ring 40. The snap-on protrusion 74 of the cap 70 snap-fits into the ring concave indentation 43. Once coupled to the ring 40, the cap 70 protects the nipple 50 from contamination. The closed second end 76 of the cap 70 touches the nipple tip 52 thereby creating a seal, which reduces the likelihood of leakage of fluid from the infant feeding system 10. The first open end 72 of the cap 70 also slides onto bottle slide-on portion 22 on the the first end 38 of the bottle 20. The snap-on protrusion 74 of the cap 70 snap-fits into the bottle indentation 23 on the first end 38 of the bottle 20. When the cap 70 is coupled to the bottle 20, the bottle can rest vertically on top of the closed second end 76 cap 70. By coupling the cap 70 to the first end 38 of the bottle 20, the cap 70 is kept from being misplaced or lost. Further, the coupling protects the inside of the cap 70 from contamination when the feeding system 10 is in use. The length of the diameter C1 of the cap 70 is the same as the diameter C2 of the cap 70. The closed second end 76 of the cap 70 is flat to allow the infant feeding system 10 to be positioned vertically on the closed second end 76 of the cap 70. The sides 78 of the cap 70 are flat and the side lengths C4 are equal. The cap 70 is cylindrical in shape as to allow full protection of the nipple 50.

In the particular embodiment, the cap 70 is constructed from polypropylene material; however, in other embodiments the cap 70 may also be constructed from any rigid or semi-rigid materials such as steel, aluminum, wood, plastic, carbon fiber, or glass. In the particular embodiment, the cap 70 is semi-transparent; however, in other embodiments, the cap 70 may also transparent or non-transparent.

Figure 5:
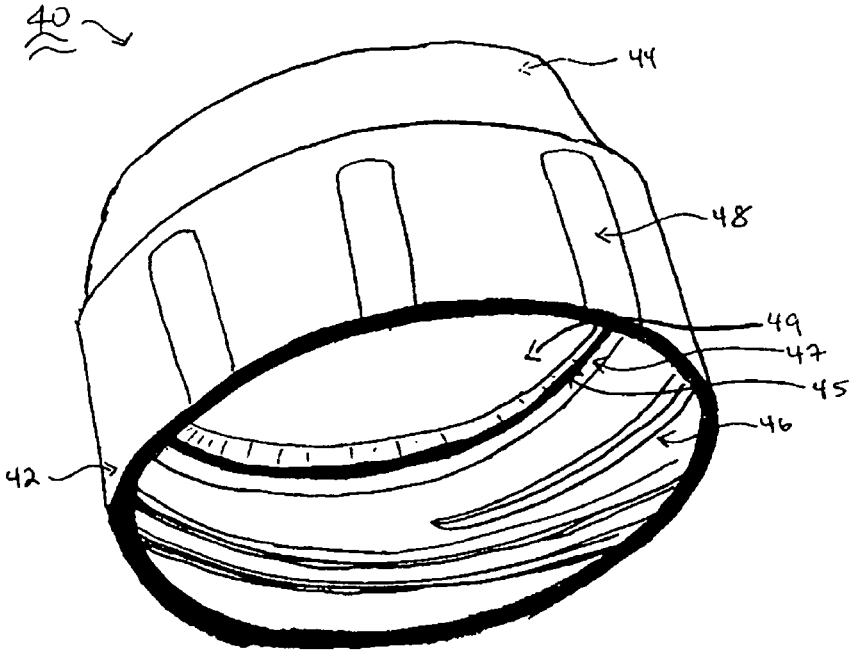
FIG. 5 shows the perspective view of the ring in accordance with at least some of the embodiments.

FIG. 5 illustrates the perspective view of the ring 40 in accordance with at least one embodiment. In particular, the first end 42 of the ring 40 is configured to couple to the second end 37 of the bottle 20. The ring 40 comprises of threads 46 on the inside diameter to enable the ring 40 to threadingly couple to the second end 37 of the bottle 20. The ring 40 couples to the bottle 20 so that the nipple 50, when fit into the ring 40, is secured to prevent fluid leakage. Further, the secure fit reduces movement of the nipple 50 when the infant is sucking on the nipple 50. In one embodiment, when the ring 40 is coupled to the second end 37 of the bottle 20, there is a gap between the first end 42 of the ring 40 and the shoulder 21 of second end 37 of the bottle 20 to allow air to enter the space between the ring threads 46 and bottle threads 35. The ring 40 has raised bumps 48 on the outer circumference to provide traction when un-coupling the ring 40 from the bottle 20. The ring 40 also contains an aperture 49 in the second end 44 of the ring 40 to allow the ring 40 to receive the constricted section 60 of the nipple 50 creating a secure fit within the ring 40. The second end 44 of the ring 40 comprises an inward edge 47 containing a ring hook 45 on the aperture 49 edge allowing the nipple ledge indentation 95 found on the nipple ledge 63 to securely fit within the ring 40 and against the rim 36 on the second end 37 of the bottle 20. The particular diameter of the aperture 49 allows the nipple 50 to be coupled to the ring 40 by being loaded from the second end 44 of the of the ring 40 instead of being pulled up through the first end 42 of the ring 40 which would require the user to touch the nipple top 53 thereby possibly contaminating the nipple 50. The nipple 50 can be coupled to the ring 40 by deforming the muffin top 56 and pushing the circular second end 91 of the nipple 50 through the ring aperture 49. The nipple vent system 92 fits into the ring 40 so that the nipple ledge 63 fits securely against the inner wall of the ring 40 reducing movement of the nipple 50 as well as correctly positioning the nipple vent system 92 so that the nipple flap 68 is positioned against the bottle inner wall 33.

In the particular embodiment, the ring 40 is constructed from polypropylene material; however, in other embodiments the ring 40 may also be constructed from any rigid or semi-rigid materials such as steel, aluminum, wood, plastic, carbon fiber, or glass. In the particular embodiment, the ring 40 is semi-transparent; however, in other embodiments, the ring 40 may also transparent or non-transparent.

Figure 6:
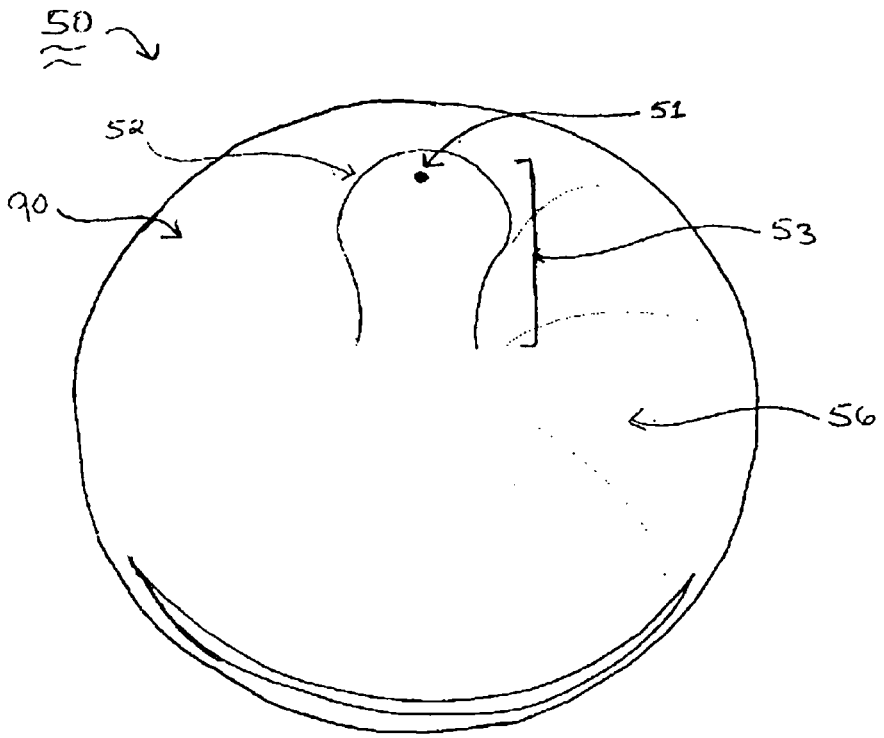
FIG. 6 shows the top view of the nipple in accordance with at least some of the embodiments.

FIG. 6 illustrates a top-view of the nipple 50 in accordance with at least some of the embodiments. In particular, the first end 90 of the nipple 50 contains a bulbous nipple top 53 with at least one aperture 51 to allow fluid to exit the infant feeding system 10 when the infant sucks on the nipple 50, and a muffin top 56. In one embodiment, the aperture 51 is positioned in the center of the nipple tip 52 to allow the fluid to enter the infant's mouth at the center or roof of the mouth.

Figure 7:
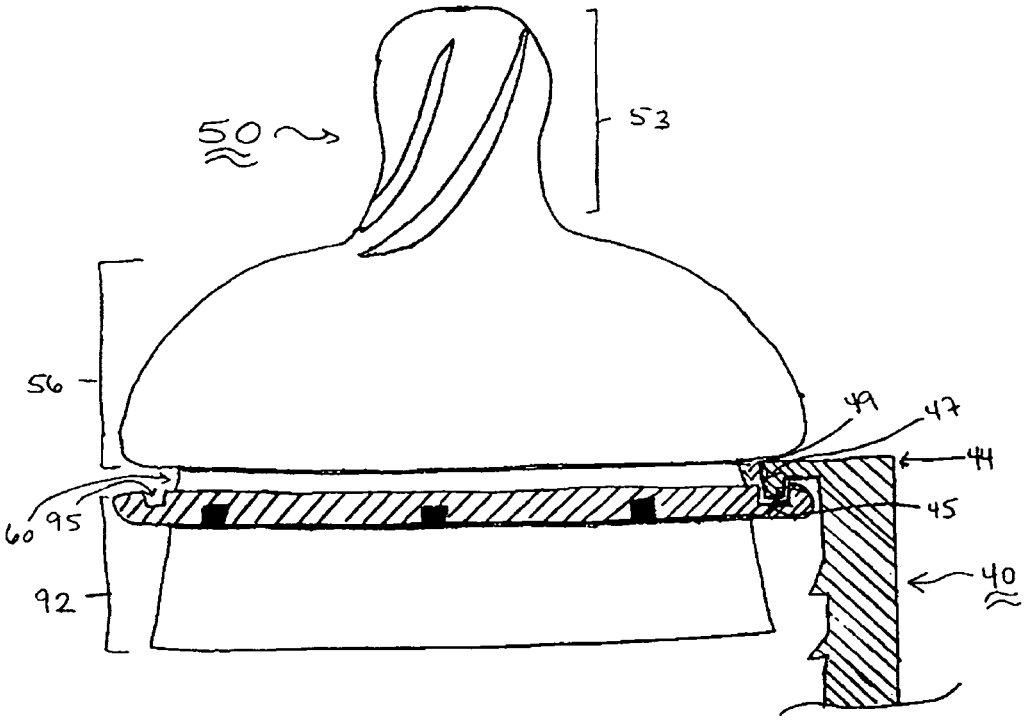
FIG. 7 shows the cross section of the coupling of the nipple and ring in accordance with at least some of the embodiments.

FIG. 7 shows the cross section of the coupling of the nipple 50 and ring 40 in accordance to one embodiment. The ring 40 is configured to enable the nipple 50 to couple to the second end 37 of the bottle 20. The ring 40 comprises a second end 44 containing an aperture 49 to allow the nipple 50 to securely fit within the ring 40. The constricted section 60 of the nipple 50 fits within the ring aperture 49. The second end 44 of the ring 40 has an inward edge 47 containing a ring hook 45 on the aperture 49 edge to allow the nipple ledge indentation 95 to securely fit within the ring 40 and against the rim 36 of the second end 37 of the bottle 20. When the nipple 50 is coupled to the ring 40, the muffin top 56 and bulbous nipple top 53 are above the second end 44 of the ring 40 and the vent system 92 is below the ring 40.

Figure 8:
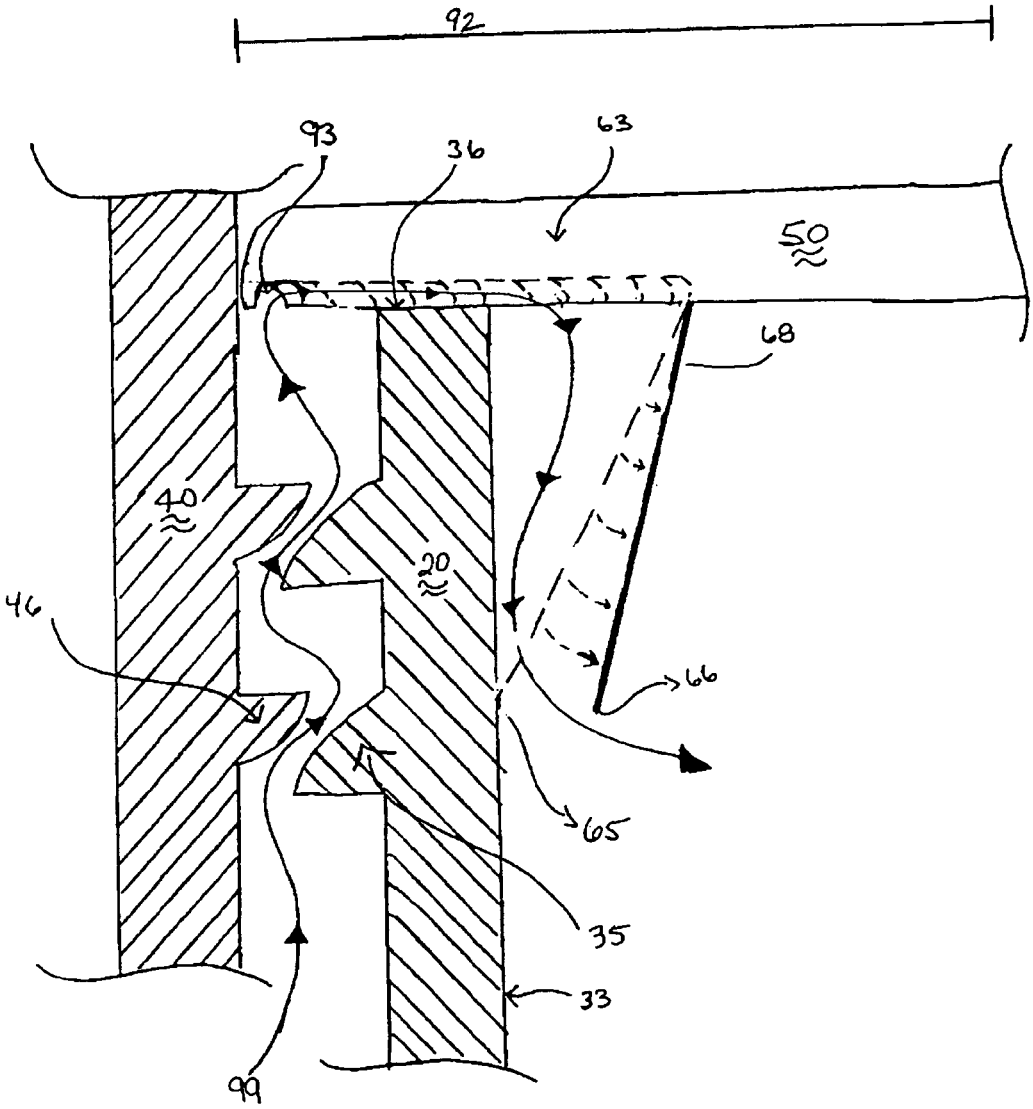
FIG. 8 shows the cross section of the coupling of the nipple, ring, and bottle in accordance at least some of the embodiments.

FIG. 8 shows a cross section view of the coupling of the nipple 50, ring 40, and bottle 20 illustrating the nipple vent system 92 in accordance to one embodiment. In particular, the vent system 92 is comprised of concave channels 93, a ledge 63, and a nipple flap 68. The vent system 92 enables air to enter the infant feeding system 10 from the outside of the bottle 20 to reduce the negative pressure within the infant feeding system 10. The ledge 63 of the nipple 50 abuts the second end 44 of the ring 40 and the second end 37 of the bottle 20 at the rim 36 of the bottle 20 to create a seal. The concave channels 93 are contained in the ledge 63 with one end of the concave channels 93 at the nipple flap 68 extends out toward the space between the ring 40 and bottle 20. In one embodiment, there is a plurality of concave channels 93. The concave channels 93 provide a path for air to enter into the infant feeding system 10 in the direction indicated by the arrows 99. In one embodiment, the concave channels 93 are perpendicular to the nipple flap 68. In one embodiment, the concave channels 93 are parallel to each other. When the nipple 50 is coupled to the bottle 20 by the ring 40, the ledge 63 creates a seal against the rim 36 of the bottle 20. The nipple flap 68 abuts the inside surface of the bottle inner wall 33 at a diagonal angle. The nipple flap 68 is positioned on the bottle inner wall 33 to provide a seal inside the infant feeding system 10. In one embodiment, the bottle inner wall 33 has a diagonal angle opposite the nipple flap 68. At rest, the nipple flap 68 is at first position 65. When there is air flow into the infant feeding system 10 in the direction indicated by the arrows 99, the nipple flap 68 is at position 66. As negative pressure increases within the infant feeding system 10, the nipple flap 68 moves from first position 65 to second position 66 causing air from outside the infant feeding system 10 to move up into the gap between the ring 40 and bottle 20 in the direction indicated by the arrows 99 and around the bottle threads 35 and ring threads 46. Air then flows into the concave channels 93, through the space between the bottle inner wall 33 and the nipple flap 68 in second position 66 in the direction indicated by the arrows 99, thereby relieving the negative pressure. The placement of the vent system 92 allows for air to enter the infant feeding system 10 in the direction indicated by the arrows 99 and reduces negative pressure inside the infant feeding system 10, thereby reducing the stress and strain on the infant and reducing the likelihood of nipple collapse.

What is claimed is:

1. An infant feeding system comprising:

a bottle with a closed first end and a second end comprising an aperture that is configured to receive a liquid or semi-liquid substance into the bottle;

a nipple comprising a vent system comprising a horizontal ledge that is attached to an end of the nipple that couples to the bottle of the infant feeding system, wherein the horizontal ledge comprises a plurality of channels on the underside of the horizontal ledge configured to enable air to flow into the bottle through a gap between a ring and bottle threads; and a flexible uninterrupted downward flap along an entire circumference of the horizontal ledge wherein the flap extends downward diagonally from the ledge to abut the inside surface of the bottle wall to create a seal when pressure on the inside and outside of the bottle is equal; wherein the flap moves off the inside wall of the bottle to allow air to enter from outside of the bottle through the space between the ring and the bottle threads through the channels in the horizontal ledge and then through a temporary gap created between the inside of the bottle and flap and into the bottle, when the pressure between the inside and outside of the bottle is not equal;

a ring configured to enable the nipple to couple to the second end of the bottle; and a cap configured to couple to the second end of the ring and configured to couple to the first end of the bottle.

2. The infant feeding system of claim 1 wherein the ring comprises a first end that interfaces with the open second end of the bottle and a second end that is configured to receive a constricted section of the nipple by compressing the circular second end of the nipple and loading the nipple horizontal ledge into a ring section to allow assembly without the user handling a bulbous nipple tip.

3. The infant feeding system of claim 1 wherein the bottle further comprises two concave indentations.

4. The infant feeding system of claim 3 wherein the concave indentations further comprise raised grips.

5. The infant feeding system of claim 1 wherein the bottle, ring, and cap comprises polypropylene material.

6. The infant feeding system in claim 1 wherein the ring threadingly couples to the bottle.

7. The infant feeding system in claim 1 wherein when the cap couples to the second end of the ring, the cap compresses the bulbous nipple tip.

8. An infant feeding system comprising:

a nipple that is configured to couple to a bottle by way of a ring, wherein the nipple comprises:

a first end with at least one aperture and a circular second end wider than the first end, wherein the first end of the nipple forms an elongated bulbous tip and the circular second end is received by the ring to couple to the bottle;

a constricted section proximate to the circular second end wherein the constricted section is configured to receive the ring and the constricted section comprises a horizontal ledge with a plurality of channels on the underside of the horizontal ledge configured to enable air to flow into the bottle through a gap between the ring and bottle threads; and a flexible uninterrupted downward flap along an entire circumference of the horizontal ledge wherein the flap extends diagonally downward from the horizontal ledge to abut the inside surface of the bottle to create a seal when pressure on the inside and outside of the bottle is equal; wherein the flap moves off the inside wall of the bottle to allow air to enter from outside of the bottle through the space between the ring and the bottle threads through the channels in the horizontal ledge and then through a temporary gap created between the inside of the bottle and flap and into the bottle, when the pressure between the inside and outside of the bottle is not equal.

9. An infant feeding system of claim 8 wherein the nipple comprises silicone rubber material.

10. An infant feeding system of claim 8 wherein the first end and circular second end of the nipple are configured to have the tactile feel of a mother's natural breast and a second end of the nipple with a larger diameter than the elongated nipple tip.

11. An infant feeding system of claim 8 further wherein the first end of the nipple has a length of one quarter inch to one and one quarter inches wherein the elongated bulbous nipple tip reaches far back in the baby's mouth.

12. An infant feeding system of claim 8 wherein the ring comprises a first end that interfaces with the open second end of the bottle and a second end that is configured to receive the constricted section of the nipple by compressing the circular second end of the nipple and loading a nipple ledge indentation into the ring to allow assembly without the user handling the bulbous nipple tip.

13. An infant feeding system in claim 8 wherein the ledge of the nipple is configured to abut the second end of the ring and the bottle.

14. A vent system comprising:

a horizontal ledge that is attached to a second end of a nipple that couples to a bottle of an infant feeding system, wherein the horizontal ledge comprises a plurality of channels on the underside of the horizontal ledge configured to enable air to flow into the bottle through a gap between a ring and bottle threads; and a flexible uninterrupted downward flap along an entire circumference of the horizontal ledge wherein the flap extends downward diagonally from the horizontal ledge to abut the inside surface of the bottle wall to create a seal when pressure on the inside and outside of the bottle is equal; wherein the flap moves off the inside wall of the bottle to allow air to enter from outside of the bottle through the space between the ring and the bottle threads through the channels in the horizontal ledge of the nipple and then through a temporary gap created between the inside of the bottle and flap and into the bottle, when the pressure between the inside and outside of the bottle is not equal.

15. A vent system in claim 14 wherein the second end of the nipple is circular and wider than a first end of the nipple.

16. A vent system in claim 14 wherein the first end of the nipple is an elongated bulbous tip.

17. A vent system in claim 14 wherein the flexible uninterrupted downward flap along an entire circumference of the horizontal ledge extends downward diagonally from the ledge to abut the inside surface of the bottle to create a seal when pressure on the inside and outside of the bottle is equal, wherein the flap moves off the inside wall of the bottle when the pressure is unequal between the outside and inside of the bottle allowing air to enter from the outside of the bottle to equalize the pressure.

18. The infant feeding system in claim 1 wherein vent system is configured to enable the bottle to be positioned in any orientation during feeding to allow proper venting without any leakage.

19. An infant feeding system of claim 8 wherein the infant feeding system is configured to enable the bottle to be positioned in any orientation during feeding to allow proper venting without any leakage.

20. A vent system in claim 14 wherein the vent system in configured to enable the bottle to be positioned in any orientation during feeding and allow proper venting without any leakage.

* * * * *